US010526179B2

(12) United States Patent
Childress

(10) Patent No.: US 10,526,179 B2
(45) Date of Patent: Jan. 7, 2020

(54) PORTABLE LIFTING APPARATUS

(71) Applicant: Donald Bruce Childress, Daphne, AL (US)

(72) Inventor: Donald Bruce Childress, Daphne, AL (US)

( * ) Notice: Subject to any disclaimer, the term of this patent is extended or adjusted under 35 U.S.C. 154(b) by 265 days.

(21) Appl. No.: 15/674,729

(22) Filed: Aug. 11, 2017

(65) Prior Publication Data

US 2018/0044152 A1 Feb. 15, 2018

Related U.S. Application Data

(60) Provisional application No. 62/373,452, filed on Aug. 11, 2016.

(51) Int. Cl.

| | |
|---|---|
| ***B66F 7/04*** | (2006.01) |
| ***B66F 7/06*** | (2006.01) |
| *B66F 7/08* | (2006.01) |

(52) U.S. Cl.

CPC ..... *B66F 7/04* (2013.01); *B66F 7/0616* (2013.01); *B66F 7/0633* (2013.01); *B66F 7/085* (2013.01)

(58) Field of Classification Search

CPC .. B66F 7/00; B66F 7/04; B66F 7/0641; B66F 9/00; B66F 9/08

See application file for complete search history.

(56) References Cited

U.S. PATENT DOCUMENTS

| | | | | |
|---|---|---|---|---|
| 9,527,707 | B1 * | 12/2016 | Fehringer | B66F 7/26 |
| 2006/0076543 | A1 * | 4/2006 | Williamson | B66F 7/02 254/325 |
| 2013/0343849 | A1 * | 12/2013 | Gobert | B60P 1/5438 414/540 |
| 2018/0044152 | A1 * | 2/2018 | Childress | B66C 19/02 |

* cited by examiner

*Primary Examiner* — Lee D Wilson

(74) *Attorney, Agent, or Firm* — ADAMSIP, LLC; J. Hunter Adams; Stephen Thompson

(57) ABSTRACT

A portable lifting apparatus is provided. The apparatus has a modular frame comprising a first frame member and a second frame member, which in combination support a load-bearing beam having a lifting device secured thereto above a lifting surface. The first frame member, the second frame member, and the lifting device are each removably secured to the beam such that the apparatus may be disassembled into constituent components for transport or storage. Each frame member may be configured to disassemble into constituent components comprising a base and two or more support rails. The apparatus may further comprise a counterbalance. The counterbalance may serve to balance load distribution when the apparatus in use and act as a storage receptacle for the first and second frame members, the beam, and the lifting device when the apparatus is disassembled.

10 Claims, 4 Drawing Sheets

PORTABLE LIFTING APPARATUS

CROSS-REFERENCE TO RELATED APPLICATIONS

This application claims priority to U.S. Provisional Patent Application No. 62/373,452 entitled "Portable Lifting Apparatus," filed Aug. 11, 2016, which application is incorporated herein in its entirety by reference.

FIELD OF THE INVENTION

The subject matter of the present disclosure refers generally to a portable lifting apparatus.

BACKGROUND

Professionals in a wide range of fields frequently need to lift equipment, building materials, or other heavy objects above a ground surface in order to perform various tasks. Often times, construction projects require these professionals to lift and subsequently transport various equipment and/or building materials to and from the rooftops of buildings. This is especially true for those professionals working in the fields of roofing or heating, ventilation, and air conditioning (HVAC) installation and repair. In some instances, heavy machinery lifting equipment, such as heavy-duty cranes with an attached cherry picker, hoist, and boom may be used to lift heavy materials. However, the time and expense associated with the transportation of such equipment to a desired location often renders the use of such heavy machinery largely impracticable. Additionally, the use of heavy machinery lifting equipment is not practical in many situations due to worksite accessibility problems. For instance, the oversized dimensions of most heavy machinery lifting equipment often exceed those afforded by smaller worksites or by pathways leading up to a worksite. Moreover, heavy machinery lifting equipment generally cannot be utilized in worksites having saturated or loose ground surfaces safely and/or without damaging the ground surface due to the intense weight of such equipment. Thus, as a result of the above-described issues, individuals often have to haul their equipment and/or building materials, often weighing hundreds of pounds, to roof tops or other elevated locations themselves, which can be extremely exhausting, time consuming, and dangerous.

A variety of non-heavy-machinery lifting devices designed for personal use or small-scale lifting jobs, e.g., such as hand trucks, car jacks, and small-scale boom and hoist devices, have been developed over the years. However, while such devices may sometimes provide improved portability over heavy machinery lifting equipment, such devices are not designed for commercial lifting applications, such as HVAC or roofing installation or repair. Known devices of this kind are generally designed to suspend and lower materials short distances—typically limited to a few inches or a few feet—and thus cannot be utilized in applications that require heavy materials to be transferred from a ground surface to a building's rooftop, or vice versa. Moreover, many such known devices are often configured as to only retain an assembled configuration, i.e., they cannot be readily disassembled to reduce the amount of storage space taken up by the device when the device is not in use. Additionally, those devices that can be disassembled often may only be done so through the aid and use of tools. As such, disassembling and subsequently reassembling such devices is a generally time consuming task, which renders such devices unsuitable for use in time-sensitive applications requiring the device to be transported and subsequently utilized across multiple worksites.

Accordingly, there is a need in the art for a portable lifting apparatus suitable for commercial lifting applications. Additionally, there is a need in the art for a portable lifting apparatus designed for rapid assembly and disassembly in order to reduce the space occupied by the apparatus when not in use.

SUMMARY

In accordance with the present disclosure, a portable lifting apparatus is provided. The apparatus has a modular frame comprising a first frame member and a second frame member, which in combination support a load-bearing beam above a lifting surface when the apparatus is in an upright position. To lift materials above the lifting surface, the apparatus has a lifting device secured to the beam that is configured to lower and retract a cable attached thereto. In a preferred embodiment, the lifting device is automated such that the lowering and retraction of the cable may be controlled via engagement with an actuator operably connected to the lifting device. After securing the cable to a desired object, the lifting device may be engaged to lift the object above the lifting surface. The first frame member, second frame member, and lifting device are each removably secured to the beam such that the apparatus may be disassembled into constituent components in order to reduce the amount of space occupied by the apparatus when stored or transported. As such, the apparatus of the present disclosure may be transported to and from worksites, e.g., to and from a building's rooftop via the internal corridors of the building, which are generally not navigable for heavy machinery lifts. To provide for rapid assembly and disassembly, the first and second frame members may be removably secured to the beam via quick-release locking pins.

The first frame member and the second frame member each comprise a base that has at least two support rails extending upwardly therefrom. The base of each frame member is configured to support the assembled apparatus in an upright position on the lifting surface. Preferably, each support rail has a first end removably secured to its respective base and a second end removably secured to the beam in order to further limit the amount of space occupied by the apparatus when disassembled. In a preferred embodiment, each support rail is removably secured to its respective base via a quick-release locking pin. In some instances, each support rail may be extendable. In one preferred embodiment, each support rail may comprise an extension arm slidably disposed within a tube such that the support rail may be extended or shortened by sliding the extension arm in or out of the tube. In this way, the support rails of the first and second frame member may be adjusted to adjust the overall height of the apparatus or to accommodate worksites having uneven surfaces. The extension arm may be removably secured to the tube such that the support rail can be disassembled into two separate pieces. In such embodiments, the extension arm and tube of each support rail may be removably secured via a quick-release locking pin.

The lifting device may be movably secured to the beam such that the lifting device may move from a first end of the beam a second end of the beam, thereby allowing horizontal movement of an object once suspended by the lifting device. In some instances, the lifting device may have rollers or wheels associated therewith, such as a push-beam trolley, that allow the lifting device to roll upon a surface of the beam. To facilitate the transfer of an object to and from elevated worksites, the length of the beam may be such that at least one end of the beam extends beyond a perimeter defined by the first and second frame member when the apparatus is assembled. For instance, the apparatus may be assembled on the rooftop of a building such that the first and second frame member rest upon the building's roof and a portion of the beam extends over an edge of the building over a ground surface. To retrieve an object located on the ground surface, e.g., an HVAC unit, the lifting device is moved to the portion of the beam suspended above the ground surface. The cable of the lifting device is then lowered to the ground, secured to the object, and retracted. Once the object is suspended above the rooftop, the lifting device is moved to a portion of the beam within the perimeter defined by the first and second frame member and the object is lowered and released onto the rooftop surface. Thus, as the foregoing example illustrates, the apparatus of the present disclosure may find use in a variety of commercial lifting applications.

To reduce the possibility of the apparatus overturning while lifting a load, the apparatus may further comprise a counterbalance and/or anchor secured to at least one of the first frame member, the second frame member, and the beam. To transport the apparatus, the counterbalance may comprise a receptacle having dimensions sufficient to store the first frame member, the second frame member, the beam, and the lifting device therein when the apparatus is disassembled.

The foregoing summary has outlined some features of the apparatus of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purposes of the device and methods disclosed herein. Those skilled in the pertinent art should also realize that such equivalent designs or modifications do not depart from the scope of the device and methods of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

Figure 1:
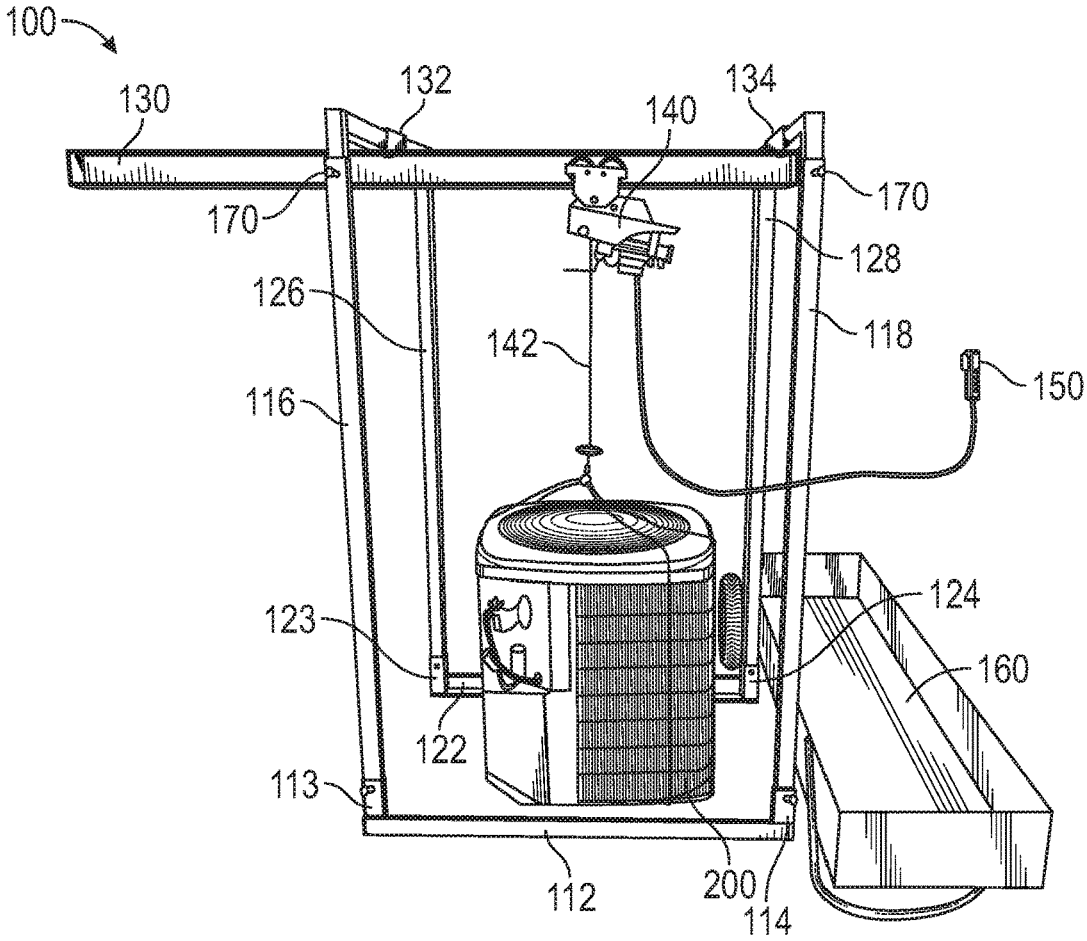
FIG. 1 shows a perspective view of an apparatus embodying features consistent with the principles of the present disclosure.

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "removably secured" and grammatical equivalents thereof are used herein to mean the joining of two components in a manner such that the two components are secured together, but may be detached from one another and re-secured together without requiring the use of specialized tools. As used herein, the term "lifting surface" and grammatical equivalents thereof refers to any surface upon which the apparatus of the present disclosure may rest upon or sit.

Turning now to the drawings, FIGS. 1-8 illustrate preferred embodiments of a portable lifting apparatus, or various components thereof. The apparatus 100 of the present disclosure is generally designed to provide a lifting device suitable for commercial and personal lifting applications alike that can be easily disassembled and re-assembled to facilitate transportation of the apparatus to and from worksites. Generally, the apparatus 100 comprises a modular frame having two horizontally spaced, parallel support structures that are elevated to support a beam 130 and a lifting device 140 above a lifting surface 300. The modular frame, beam 130, and lifting device 140 may be separated and the modular frame disassembled into constituent components to reduce the space occupied by the apparatus 100 during transport or storage.

In a preferred embodiment, the modular frame comprises a first frame member 110 and a second frame member 120, which collectively support a beam 130 above a lifting surface 300 when the apparatus 100 is assembled and placed in an upright position. The first frame member 110 and the second frame member 120 are both removably secured to the beam 130 such that the first frame member 110, the second frame member 120, and the beam 130 may be separated in order to reduce the amount of space occupied by the apparatus 100 when stored or transported.

Secured to the beam 130 is a lifting device 140 configured to lower and retract a cable 142 associated therewith. The cable 142 may be secured around an object 200 and the lifting device 140 engaged to retract the cable 142, thereby suspending the object 200 above the lifting surface 300. The cable 142 may have a hook 144 or other attachment device secured to one of its ends to facilitate securement of the object 200. In a preferred embodiment, the lifting device 140 is automated such that the lifting device's 140 lowering and retraction of the cable 142 may be controlled through engagement with an actuator 150 operably connected to the lifting device 140. To facilitate horizontal movement of the object 200 once suspended, the lifting device 140 may be movably secured to the beam 130 such that the lifting device 130 may move from one end of the beam 130 to the other.

Figure 6:
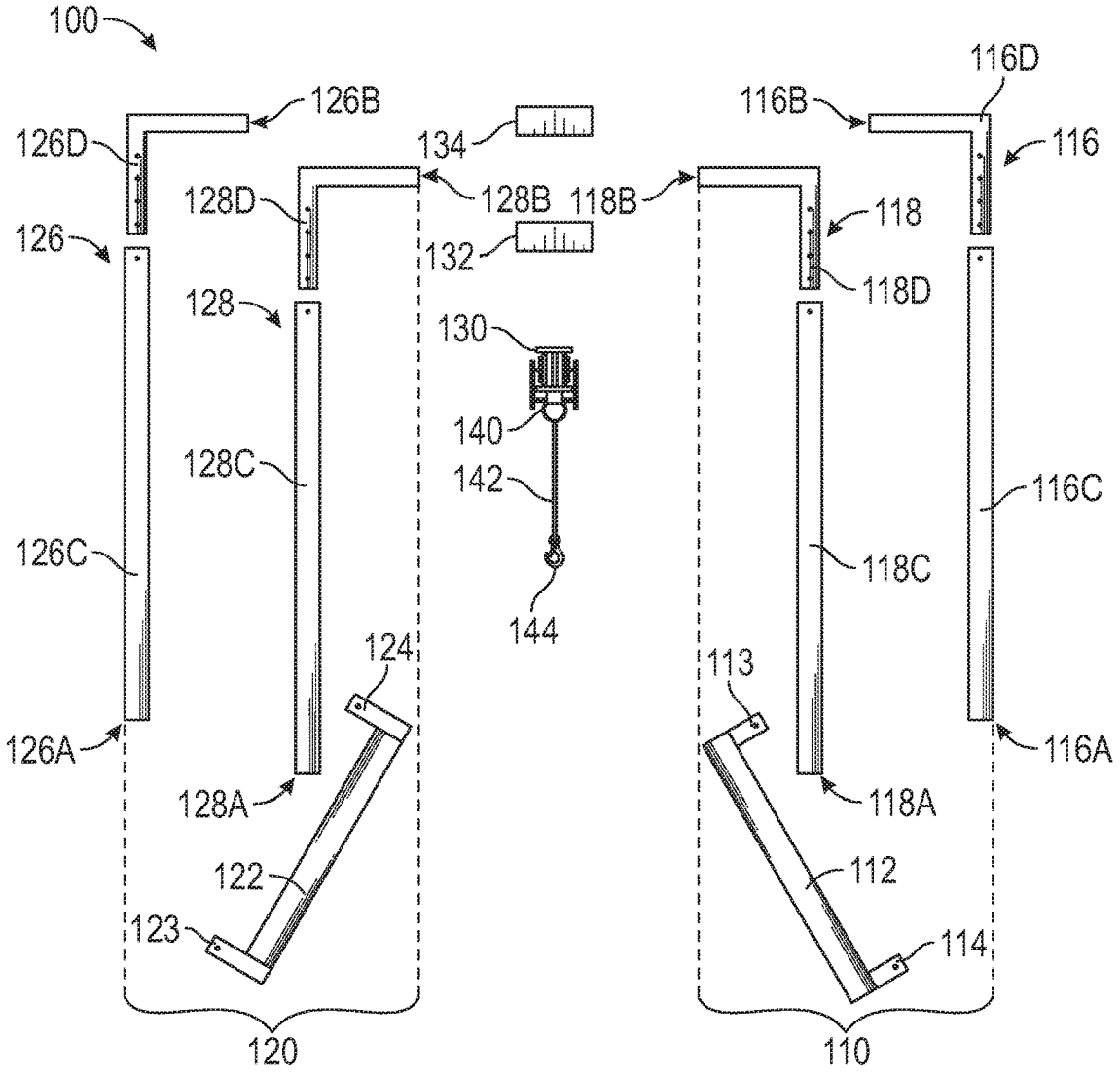
FIG. 6 shows an exploded view of an apparatus embodying features consistent with the principles of the present disclosure.
Figure 7:
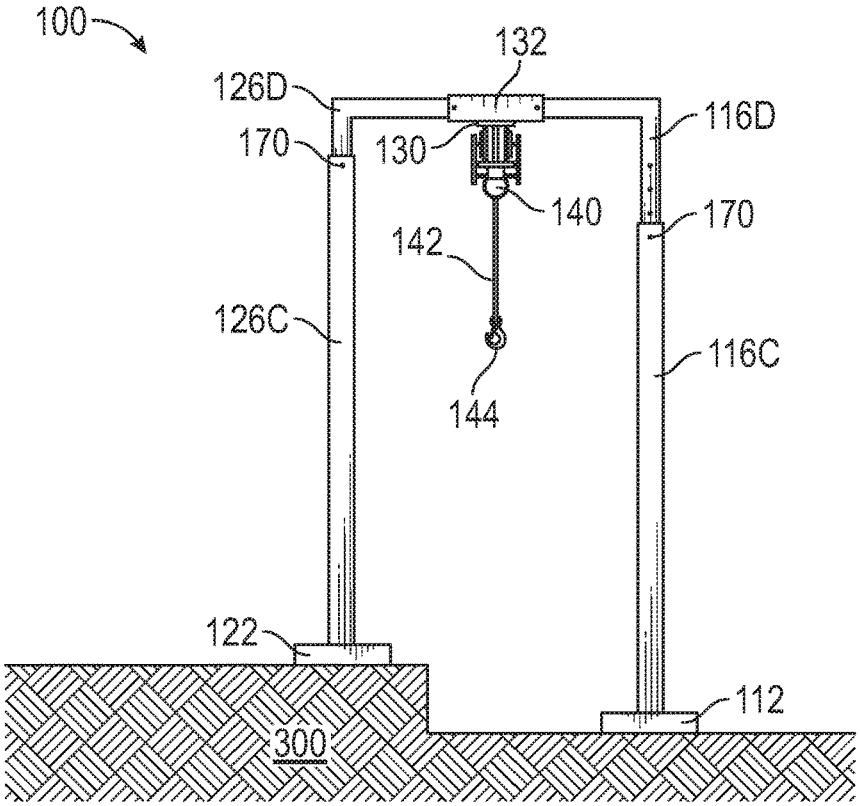
FIG. 7 shows a side view of an apparatus embodying features consistent with the principles of the present disclosure positioned on an uneven surface.
Figure 8:
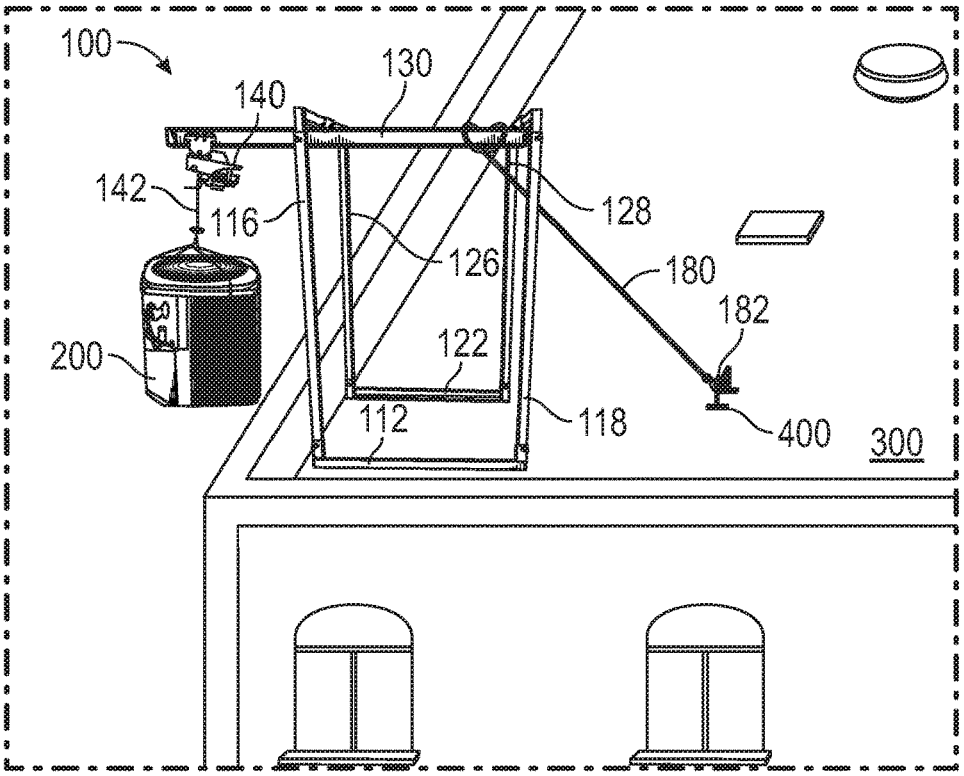
FIG. 8 shows a perspective view of an apparatus embodying features consistent with the principles of the present disclosure.

As shown in FIGS. 1-8, the apparatus 100 generally comprises a modular frame defined by a first frame member 110 and a second frame member 120, a beam 130 removably secured to the first and second frame members 110, 120, and a lifting device 140 removably secured to the beam 130. As best shown in FIGS. 1, 3, and 6-8, the first frame member 110 and the second frame member 120 each comprise a base having at least two support rails extending upwardly therefrom. The support rails of each frame member may extend upwardly from the frame member's base in parallel, as shown in FIGS. 1 and 8. Alternatively, the support rails of each frame member may splay outwardly from the base. In a preferred embodiment, the base 112 of the first frame member 110 (the "first base") has a first end 112A and a second end 112B to which a first support rail 116 and a second support rail 118 are secured, respectively, as shown best in FIGS. 1, 3, and 8. Similarly, the base 122 of the second frame member 120 (the "second base") also has a first end 122A and a second end 122B to which a third support rail 126 and a fourth support rail 128 are secured, respectively. Alternatively, one or more of each frame member's support rails may be secured between the first and second end of the frame member's base. In a preferred embodiment, the first base 112 and the second base 122 have a length of at least four feet. However, it is understood that the length of the first base 112 and the second base 122 may vary depending on the intended application.

To permit each respective frame member 110, 120 to be disassembled into smaller, constituent pieces, the support rails of each frame member are preferably removably secured to each frame member's respective base. To facilitate such removable securement, the first and second end 112A and 112B of the first base 112 and the first and second end 122A and 122B of the second base 122 may be configured to receive a support rail therein. In one such embodiment, the first and second end 112A and 112B of the first base 112 may have a first bracket 113 and a second bracket 114 secured thereto, respectively, as shown in FIGS. 1, 3, 6, and 8. Similarly, the first and second end 122A and 122B of the second base 122 may have a third bracket 123 and a fourth bracket 124 secured thereto, respectively. The first and second brackets 113, 114 and the third and fourth brackets 123, 124 may be either permanently or removably secured to the first base 112 and the second base 122, respectively.

The dimensions of each bracket are preferably such that each bracket forms a female member to which an end of a support rail may be inserted therein. In one such embodiment, the first bracket 113 is configured to receive a first end 116A of the first support rail 116 therein, the second bracket 114 is configured to receive a first end 118A of the second support rail 118 therein, the third support bracket 123 is configured to receive a first end 126A of the third support rail 126 therein, and the fourth bracket 124 is configured to receive a first end 128A of the fourth support rail 128 therein. Alternatively, the first end of each support rail may be hollowed as to form a female member in which a bracket may be inserted. Each bracket and support rail preferably has a bore extending transversely therethrough such that a support rail may be secured in a substantially fixed position within a bracket, or vice versa, by aligning the bore of the support rail with the bore of the bracket and inserting a locking pin 170 therethrough, as best shown in FIG. 1. To provide for rapid assembly and disassembly without requiring the use of tools, each locking pin 170 discussed herein preferably comprises a quick-release pin. In another preferred embodiment, each locking pin 170 may comprise a quick-release pin and a clip, wherein the quick-release pin has a bore through which the clip may be inserted to lock the quick-release pin in place. However, one of skill in the art will readily appreciate that the locking pin 170 may comprise any elongated member that may be inserted through the various bores discussed herein, e.g., a bolt and corresponding nut may be used in some in some instances.

In another preferred embodiment, the first and second end 112A, 112B of the first base 112 and the first and second end 122A, 122B of the second base 122 may have an opening therein of sufficient size to receive the first end of a support rail therein without the use of a bracket, as shown best in FIG. 7. One of skill in the art will appreciate, however, that other suitable devices or instruments configured to removably secure one object to another may be used to removably secure the support rails to the first and second base 112, 122 without departing from the inventive subject matter disclosed herein.

Figure 2:
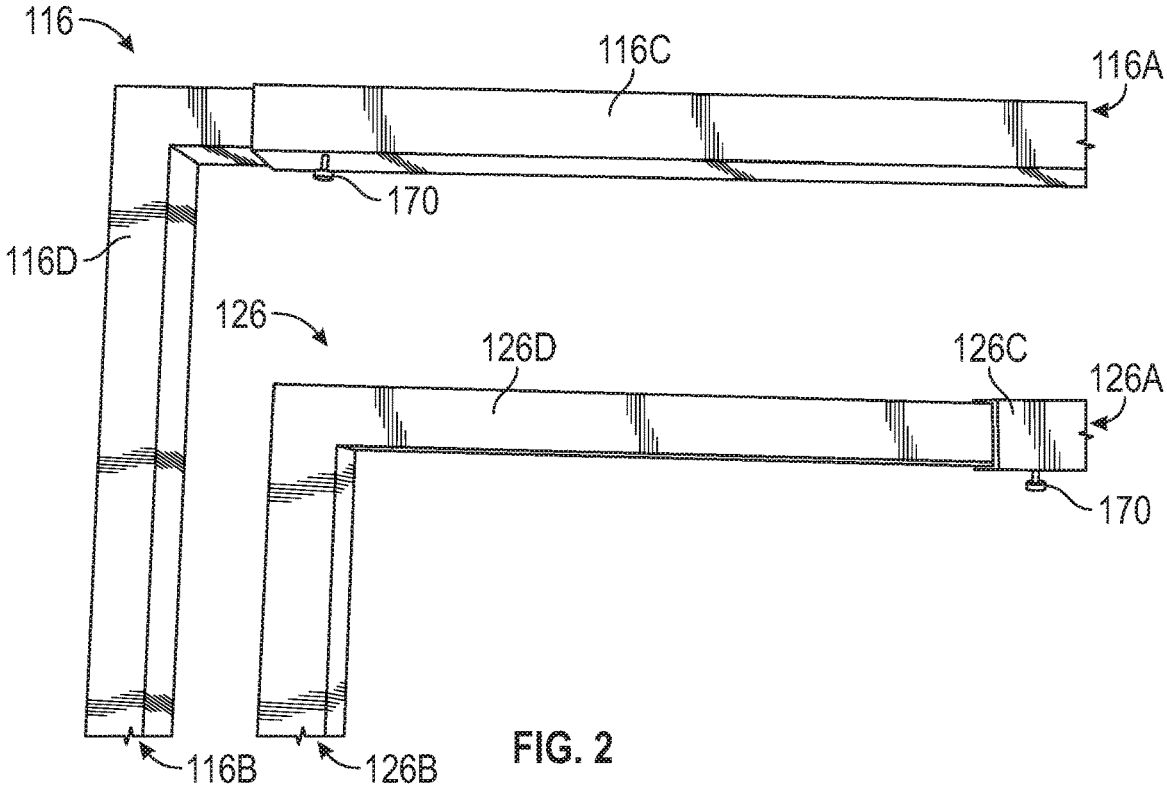
FIG. 2 shows a partial perspective view of two separate support rails embodying features consistent with the principles of the present disclosure.

To allow for adjustment of the apparatus's 100 overall height when assembled, each support rail of the first and second frame members 110, 120 may be configured to extend. In one such embodiment, each support rail comprises a tube 116C, 118C, 126C, 128C and an extension arm 116D, 118D, 126D, 128D, as best shown in FIGS. 2 and 6. In such embodiments, the first end of each support rail is defined by an end of the tube and the second end of each support rail is defined by an end of the extension arm, as further shown in FIGS. 2 and 6. Preferably, the extension arm of each support rail is removably secured to or within a corresponding tube such that the support rails 116, 118, 126, 128 may be disassembled into separate components.

For each support rail, the extension arm may be slidably disposed within the support rail's tube such that the support rail may be extended by sliding the extension arm out of the tube or collapsed by sliding the extension arm into the tube. In such embodiments, the tube of each support rail has an at least partially hollowed body having a diameter greater than at least one end of the support rail's extension arm. In one preferred embodiment, the dimensions of the extension arm and tube of each support rail are such that the extension arm may slide out of the tube to extend the overall length of the support rail to approximately 12 feet. In some instances, the extension arm and tube of each support rail may be slidably secured via a sliding rail, e.g., a linear ball slide rail, to facilitate sliding of the extension arm within the tube. In alternative embodiments, each support rail of the first and second frame member 110, 120 may be configured to telescopically extend.

The tube and extension arm of each support rail may have at least one bore extending transversely therethrough such that the support rails may be fixed in an extended configuration by sliding the extension arm into the tube, aligning the bore of the extension arm with the bore of the tube, and inserting a locking pin 170 therethrough, as best shown in FIG. 6. In a preferred embodiment, the extension arm of each support rail has multiple spaced bores therein, wherein each bore corresponds to a different height to which the support rail may be adjusted, as shown in FIGS. 6 and 7. One of skill in the art will, however, appreciate that the support rails of the first frame member 110 and the second frame member 120 may be secured in an extended configuration in alternative manners without departing from the inventive subject matter disclosed herein. For instance, in some embodiments, the extension arm may have a snap button secured thereto that is biased in an outward radial direction such that the snap button interlocks with a bore within the tube once the extension arm is pulled out of the tube a defined length. The snap button may be pressed inward to re-adjust the length of the support rail.

Figure 3:
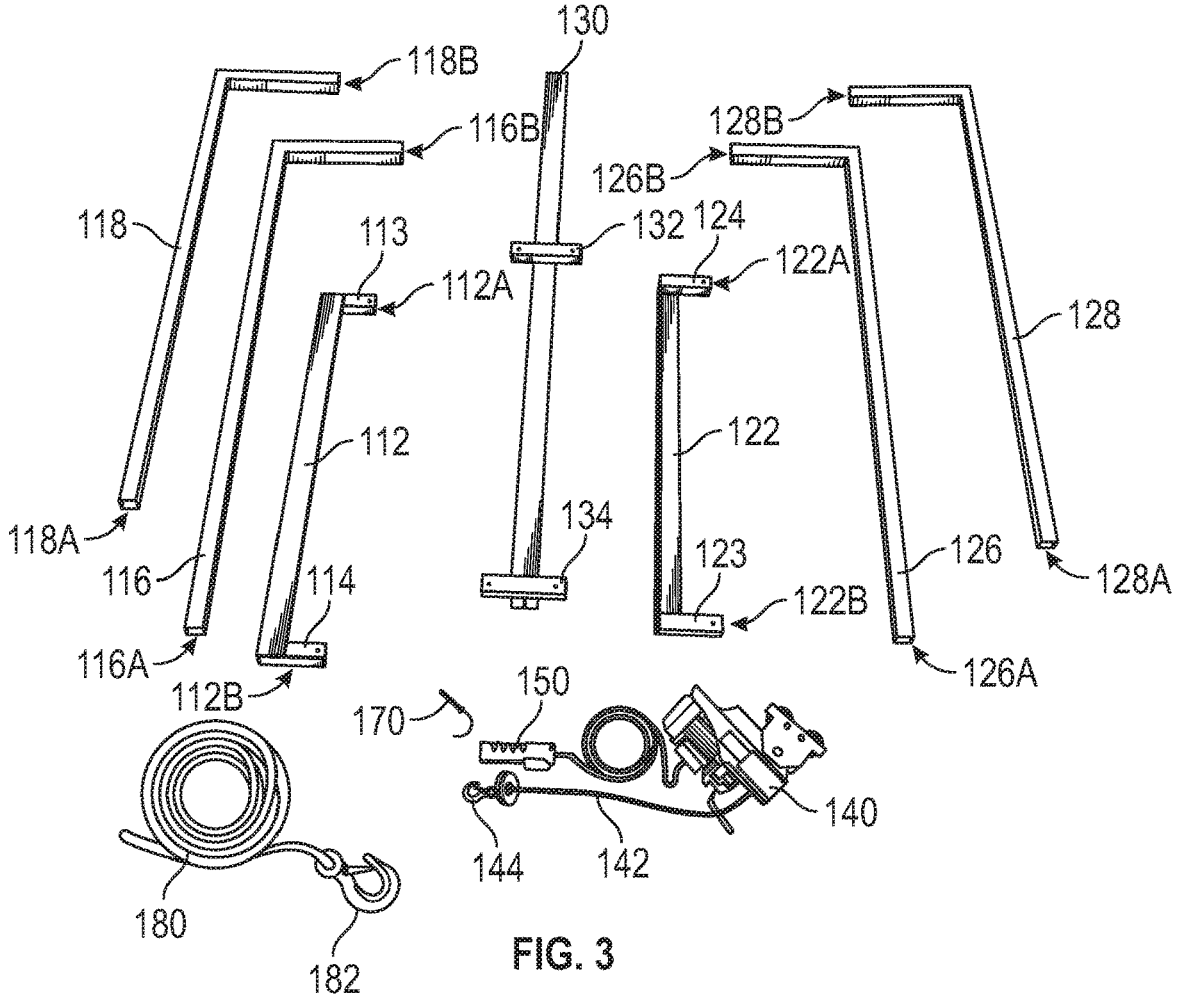
FIG. 3 shows a view of components of an apparatus embodying features consistent with the present disclosure disassembled.

By extending or collapsing the support rails 116, 118, 126, 128, a user may adjust the overall height of the apparatus 100 to increase or decrease the maximum height in which an object 200 may be suspended above a lifting surface 300 when the cable 142 attached to the lifting device 140 is fully retracted. Moreover, a user may adjust the height of the support rails 116, 118, 126, 128 to accommodate uneven lifting surfaces 300, as shown in FIG. 7. As shown in FIG. 3, the present disclosure also contemplates embodiments where each support rail 116, 118, 126, 128 of the first and second frame members 110, 120 is a unitary component that is not configured to extend.

To accommodate a wide array of commercial applications, the first and second frame members 110, 120 are preferably designed such that the apparatus 100 may support loads of at least 450 pounds without the first frame member 110 or second frame member 120 deforming or breaking. To reduce weight and provide increased portability of the apparatus 100, each component of the first frame member 110 and the second frame member 120 described above may comprise an aluminum material or other lightweight metal or metal-alloy material. However, one of skill in the art will appreciate that the components of the first and second frame members 110, 120 may comprise other materials including, but not limited to, wood, plastic, rubber, various metals such as steel, or a combination thereof without departing from the inventive subject matter disclosed herein.

As shown in FIGS. 1, 5, and 7-8, the first frame member 110 and the second frame member 120 collectively secure the beam 130 in an elevated position above a lifting surface 300 when the apparatus 100 is assembled and upright. The first frame member 110 and the second frame member 120 are removably secured to the beam 130 via each frame member's support rails. The support rails may be secured directly or indirectly to the beam 130. To suspend the beam 130 above the lifting surface 300 in a central location between the first base 112 and the second base 122, each support rail of the first frame member 110 and the second frame member 120 may be angled such that the second end of the support rails of the first frame member 110 face the second end of the support rails of the second frame member 120, and vice versa, when the apparatus 100 is assembled. In a preferred embodiment, each support rail forms a right angle such that the support rail is generally L-shaped, as shown in FIGS. 2, 3, and 6. As further shown in FIG. 6, the extension arm 116D, 118D, 126D, 128D of each support rail may be generally L-shaped and the tube 116C, 118C, 126C, 128C of each support rail generally straight, such that when an end of an extension arm is disposed within a tube, the support rail, as a whole, is generally L-shaped, as shown best in FIGS. 2 and 6. In such embodiments, an extension arm's shape may prevent the extension arm from sliding completely into the body of the support rail's tube.

Figure 5:
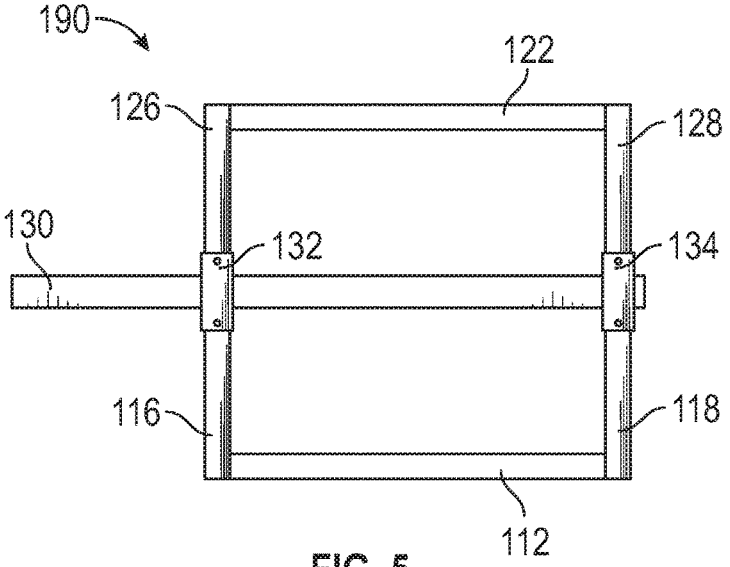
FIG. 5 shows a top view of an apparatus embodying features consistent with the principles of the present disclosure.

The beam 130 may have a first bracket 132 and a second bracket 134 either permanently or removably secured thereto. As shown in FIG. 5, the first and second brackets 132, 134 are preferably secured to a top side of the beam 130. Preferably, the first bracket 132 is configured to receive a second end 116B of the first support rail 116 and a second end 126B of the third support rail 126 therein, and the second bracket 134 is configured to receive a second end 118B of the second support rail 118 and a second end 128B of the fourth support rail 128 therein. Alternatively, the second end 116B of the first support rail 116 and the second end 126B of the third support rail may be configured to receive a first end and a second end of the first bracket 132 therein, respectively. Similarly, the second end 118B of the second support rail 118 and the second end 128B of the fourth support rail 128 may be configured to receive a first and a second end of the second bracket therein, respectively. In alternative embodiments, four separate brackets, each configured to receive the second end of a single support rail therein, may be secured to the beam 130 and utilized to removably secure the first and second frame members 110, 120 to the beam 130.

As shown best in FIG. 5, the first and second brackets 132, 134 are preferably secured perpendicularly to the beam 130 and in parallel relation with respect to each other. To ensure the support rails of the first frame member 110 and the second frame member 120 can be aligned and subsequently secured to the beam 130, the first bracket 132 and the second bracket 134 are spaced apart from each other approximately the same distance as the distance existing between the first support rail 116 and the second support rail 118 and/or the distance between the third support rail 126 and the fourth support rail 128. The first bracket 132 and the second bracket 134, as well as the second end of each support rail, each preferably have at least one bore extending therethrough such that the support rails may be secured within a corresponding bracket by aligning the bore on the second end of the support rail and the bore of the bracket and inserting a locking pin 170 therethrough, as best shown in FIG. 5. In a preferred embodiment, the second end of each support rail has multiple bores therethrough such that the distance between the first base 112 and the second base 122 can be adjusted.

When the first support rail 116 and the third support rail 126 are secured to the first bracket 132, the first support rail 116 and the third support rail 126 are linearly aligned. Similarly, when the second support rail 118 and the fourth support rail 128 are secured to the second bracket 134, the second support rail 118 and the fourth support rail 128 are linearly aligned. Accordingly, when the first frame member 110 and the second frame member 120 are secured to the beam 130, the first base 112 and the second base 122 are held in parallel relation and the first support rail 116 and the second support rail 118 are held in parallel relation, and the third support rail 126 and the fourth support rail 128 are held in parallel relation, as shown best in FIG. 5. Thus, when secured to the beam 130 in the above-described manner, the first frame member 110 and the second frame member 120 define a framed perimeter 190, as further shown in FIG. 5. Although the framed perimeter 190 defined by the first and second frame members 110, 120 in FIG. 5 is generally square-shaped, it is understood the shape and dimensions of the framed perimeter 190 may vary depending on the width of the first and second bases 112, 122.

The lifting device 140 is removably secured to the beam 130 and is configured to lower and retract a cable 142 attached thereto. As used herein, the term "cable" and grammatical equivalents thereof are understood to mean any elongated piece of material which can be lowered and retracted by the lifting device 140 including, but not limited to straps, chains, cables, ropes, or combinations thereof. The cable 142 may comprise materials including, but not limited to, polyester, synthetic rope, metal cable or wiring, or any other suitable material. To accommodate a wide array of commercial applications, it is preferred that the cable 142 have a tensile strength sufficient to suspend a load of at least 450 pounds above a lifting surface 300 without breaking. A first end of the cable 142 may be secured to the lifting device 140 and a second end of the cable 142 may have a securing member 144 configured to secure an object 200 to be lifted to the cable 142. In a preferred embodiment, as shown in FIGS. 6-7, the securing member 144 is a hook. However, it is understood that the securing member 144 may be any instrument or device suitable for securing an object to the cable 142 including, but not limited to, a looped portion of the cable 142, as shown in FIGS. 1 and 8, a magnet, or a clamping or clasping device.

In one preferred embodiment, the lifting device 140 is automated such that the cable 142 may be lowered or retracted by engaging an actuator 150 operably connected to the lifting device 140, as shown in FIGS. 1 and 3. When the apparatus 100 is assembled and placed in an upright position, the lifting device 140 is suspended above the lifting surface 300. To allow for horizontal movement of an object 200 once suspended by the lifting device 140, the lifting device 140 may be movably secured to the beam such that the lifting device may move from a first end of the beam 130 to a second end of the beam 130, as best shown in FIGS. 1 and 8. In some instances, the actuator 150 and lifting device 140 may be designed such that the actuator 150 can be engaged to autonomously move the lifting device 140 from one end of the beam 130 to the other. To facilitate horizontal movement of the lifting device 140, the lifting device 140 may have one or more wheels or rollers that allow the lifting device 140 to roll upon a portion the beam 130. Alternatively, the lifting device 140 may be configured to slide upon the beam 130, e.g., via slidable brackets.

In a preferred embodiment, the lifting device 140 comprises a push-beam trolley having a set of opposing wheels or rollers, as shown in FIGS. 1, 3, and 6-8. In such embodiments, the beam 130 is preferably an I-beam having an upper and lower flange with a web extending therebetween. The push-beam trolley may be secured to the I-beam by placing the opposing set of wheels or rollers of the lifting device between the upper and lower flange of the I-beam such that the web of the I-beam bisects the opposing wheels or rollers and the wheels or rollers rest upon the lower flange, as best shown in FIGS. 6 and 7. It is understood, however, that the use of an I-beam and push-beam trolley represent only one preferred embodiment of the beam 130 and lifting device 140, respectively. One of skill in the art will appreciate that the beam 130 may be any load-bearing beam suitable for the applications disclosed herein and the lifting device 140 may be any suitable device configured to lower and retract a cable 142 attached thereto. Preferably, the beam 130 comprises a metal material. Alternatively, the beam 130 may comprise a wooden, stone, or plastic material, or combinations thereof, or any other suitable material sufficient to support a lifting device 140 and the load of an object 200 in the manner described herein. To accommodate a wide array of commercial applications, the beam 130 preferably comprises material or materials sufficient to withstand suspended loads of at least 450 pounds.

Figure 4:
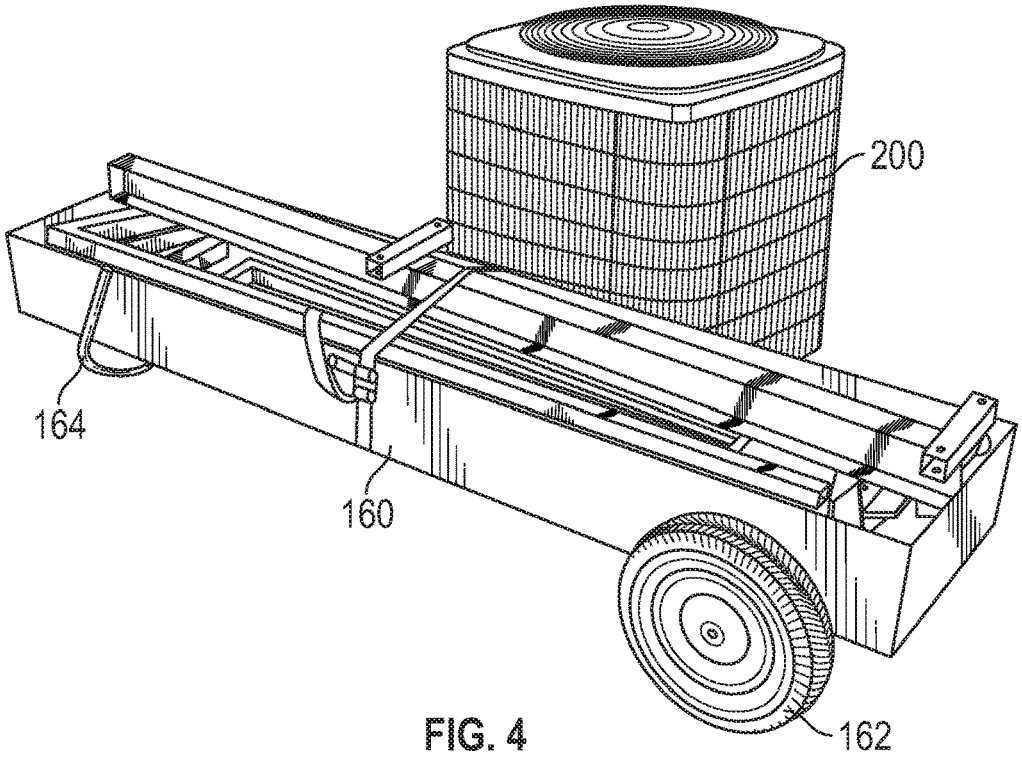
FIG. 4 shows a perspective view of an apparatus embodying features consistent with the present disclosure disassembled.

To facilitate the transfer of an object 200 to and from elevated work sites, the length of the beam 130 may be such as to extend beyond the framed perimeter 190 defined by the first and second frame members 110, 120 when the apparatus 100 is assembled, as shown in FIGS. 1, 5, and 8. For instance, the apparatus 100 may be assembled on a lifting surface 300 on a rooftop of a building such that the first and second frame members 110, 120 rest upon the building's roof and an end of the beam 130 extends over an edge of the building over a ground surface, as shown in FIG. 8. To retrieve an object 200 located on the ground surface, such as an HVAC unit as shown in FIGS. 1, 4, and 8, the lifting device 140 is moved to the end of the beam 130 extending over the edge of the building and above the ground surface. The cable 142 is lowered to the ground surface, secured to the object 200, and retracted. Once the object 200, is suspended above the rooftop, as shown in FIG. 8, the lifting device 140 is moved to a portion of the beam located within the framed perimeter 190. The lifting device 140 then lowers the cable 142 until the object 200 rests upon the rooftop at which time the cable 142 may be unsecured from the object 200.

In a preferred embodiment, only one end of the beam 130 extends beyond the framed perimeter 190. Alternatively, both ends of the beam 130 may extend beyond the framed perimeter 190. Preferably, the first bracket 132 and the second bracket 134 are configured to removably secure to the beam 130 such that the extent to which one or both ends of the beam 130 extend beyond the framed perimeter 190 may be adjusted by removing, repositioning, and subsequently re-securing the first and second brackets 132, 134 to the beam 130.

To reduce the risk of the apparatus 100 overturning while supporting a load, the apparatus 100 may further comprise a counterbalance 160 and/or an anchor 180, as shown best in FIGS. 1 and 8, respectively. The counterbalance 160 may be removably secured to the first frame member 110, the second frame member 120, or both, preferably at a location substantially near the first base 112 and/or second base 122. The counterbalance 160 and at least one support rail of each frame member may have bores extending therethrough such that the counterbalance 160 may be removably secured to the first frame member 110 and/or the second frame member 120 by aligning the bores within the support rails with the bores within the counterbalance and inserting a locking pin 170 therethrough. However, one of skill in the art will appreciate that the counterbalance 160 may be secured to the first frame member 110 and/or second frame member 120 via any device or instrument configured to removably secure to objects together without departing from the inventive subject matter disclosed herein.

In applications requiring the apparatus 100 to support a load, at least temporarily, outside the framed perimeter 190, the counterbalance 160 is preferably secured to the first frame member 110 and/or second frame member 120 opposite the end of the beam 130 extending beyond the framed perimeter 190. For instance, if an end of the beam 130 extends beyond the framed perimeter 190 adjacent the first and third support rail 116, 126, the counterbalance 160 is preferably secured to the second support rail 118 and/or fourth support rail 128, as shown in FIG. 1.

To enable convenient transport of the apparatus 100 to and from worksites, the counterbalance 160 is preferably configured to store various components of the apparatus 100 therein when the apparatus 100 is disassembled. In this way, the counterbalance 160 provides for centralized storage of constituent components of the apparatus 100, thereby enabling the apparatus 100 to be transported to and from worksites through routes and areas generally unnavigable by heavy machinery, such as a building's elevators or corridors. As shown in FIG. 4, the counterbalance 160 preferably comprises a receptacle having a base with one or more sidewalls extending upwardly therefrom and sized to accommodate various components of the apparatus 100 therein. To reduce the overall weight of the apparatus 100, the counterbalance 160 may comprise an aluminum material. In such embodiments, various objects or materials may be placed within the receptacle of the counterbalance 160 to increase its weight. Alternatively, the counterbalance 160 alone may be sufficiently weighted to counteract the effects of a load suspended outside the framed perimeter 190. Accordingly, the counterbalance 160 may comprise any suitable material including, but not limited to, metal, wood, plastic, rubber, or combinations thereof. As further shown in FIG. 4, in some instances the counterbalance 160 may also have one or more wheels 162 and/or a handle 164 secured thereto to further provide simple transport of the apparatus 100 when disassembled.

As shown in FIG. 8, the anchor 180 is configured to prevent the apparatus 100 from overturning during use by anchoring the apparatus 100 to a fixture 400 on or around the lifting surface 300. The anchor 180 comprises a strap having a first end that removably secures to at least one of the first frame member 110, the second frame member 120, and the beam 130 and a second end that removably secures to the fixture 400. As shown in FIG. 8, in some embodiments, the anchor 180 may be secured to the first frame member 110, the second frame member 120, and/or the beam 130 by tying the first end of the anchor's 180 strap thereto. In some embodiments, the second end of the anchor's 180 strap may have a hook 182, such as a j-hook, or other device or instrument configured to secure the strap to a fixture 400 attached thereto. As with the counterbalance 160, in applications requiring the apparatus 100 to support a load, at least temporarily, outside the framed perimeter 190, the anchor 180 is preferably secured to the first frame member 110, the second frame member 120, and/or the beam 130 opposite the end of the beam 130 extending beyond the framed perimeter 190, as shown in FIG. 8. When used, the strap of the anchor 180 is preferably secured to the apparatus 100 and to the fixture 400 such that the strap is taut, as further shown in FIG. 8. In some embodiments, the anchor's 180 strap may comprise a ratchet strap having a fixed strap end, an adjustable strap end, and a tension device disposed therebetween.

It is understood that versions of the inventive subject matter of the present disclosure may come in different forms and embodiments. Additionally, it is understood that one of skill in the art would appreciate these various forms and embodiments as falling within the scope of the inventive subject matter disclosed herein.

What is claimed is:

1. A lifting apparatus comprising:

a modular frame comprising:

a first frame member comprising:

a first base having a first end and a second end;

a first support rail having a first end and a second end, wherein the first end of the first support rail is removably secured to the first end of the first base; and a second support rail having a first end and a second end, wherein the first end of the second support rail is removably secured to the second end of the first base;

a second frame member comprising:

a second base having a first and a second end;

a third support rail having a first end and a second end, wherein the first end of the third support rail is removably secured to the first end of the second base; and a fourth support rail having a first end and a second end; wherein the first end of the fourth support rail is removably secured to the second end of the second base;

a beam removably secured to the second end of the first support rail, the second end of the second support rail, the second end of the third support rail, and the second end of the fourth support rail such that the first frame member and the second frame member are held in parallel to define a framed perimeter and the beam is suspended above a lifting surface when the apparatus is assembled and placed in an upright position, wherein an end of the beam extends beyond the framed perimeter;

at least one of a counterbalance and an anchor removably secured to the modular frame opposite the end of the beam extending beyond the framed perimeter;

an automated lifting device removably secured to the beam such that the lifting device may move from a first end of the beam to a second end of the beam, and wherein the lifting device is configured to raise and lower a cable attached to the lifting device; and an actuator operably connected to the automated lifting device.

2. The apparatus of claim 1, wherein a top side of the beam has a first bracket and a second bracket secured thereto, wherein the beam is removably secured to the second end of the first and third support rail via the first bracket and is removably secured to the second end of the second and fourth support rail via the second bracket.

3. The apparatus of claim 1, wherein the first support rail, the second support rail, the third support rail, and the fourth support rail each comprises:

an extension arm slidably disposed within a tube such that each support rail is extendable and collapsible by sliding the extension arm in or out of the tube, wherein the extension arm and the tube of each support rail have a bore extending transversely therethrough such that each support rail retains an extended configuration when the bore of the extension arm is aligned with the bore of the tube and a locking pin is inserted therethrough.

4. The apparatus of claim 1, wherein the counterbalance is removably secured to at least one of the first frame member and the second frame member, and wherein the counterbalance is configured to store the first frame member, the second frame member, the beam, and the actuator therein when the apparatus is unassembled.

5. The apparatus of claim 1, wherein the anchor comprises:

a strap having a first end and a second end, the first end of the strap being secured to at least one of the first frame member, the second frame member, and the beam; and a hook secured to the second end of the strap.

6. The apparatus of claim 1, wherein the first support rail, the second support rail, the third support rail, and the fourth support rail each form a right angle.

7. The apparatus of claim 2, wherein the first end of the first base is configured to receive the first end of the first support rail therein, the second end of the first base is configured to receive the first end of the second support rail therein, the first end of the second base is configured to receive the first end of the third support rail therein, and the second end of the second base is configured to receive the first end of the fourth support rail therein.

8. A lifting apparatus comprising:

a modular frame comprising:

a first frame member comprising:

a first base having a first end and a second end;

a first L-shaped rail having a first end and a second end, wherein the first end of the first L-shaped rail is removably secured to the first end of the first base; and a second L-shaped rail having a first end and a second end, wherein the first end of the second L-shaped rail is removably secured to the second end of the first base;

a second frame member comprising:

a second base having a first and a second end;

a third L-shaped rail having a first end and a second end, wherein the first end of the third L-shaped rail is removably secured to the first end of the second base; and a fourth L-shaped rail having a first end and a second end; wherein the first end of the fourth L-shaped rail is removably secured to the second end of the second base;

an I-beam having a length greater than each respective base of the first frame member and the second frame member removably secured to the second end of the first L-shaped rail, the second L-shaped rail, the third L-shaped rail, and the fourth L-shaped rail such that the first frame member and the second frame member are held in parallel to define a framed perimeter and the I-beam is suspended above a lifting surface when the apparatus is placed in an upright position, wherein an end of the I-beam extends beyond the framed perimeter;

an automated push-beam trolley removably secured to the I-beam such that the push-beam trolley may move from a first end of the I-beam to a second end of the I-beam, wherein the automated push-beam trolley is configured to raise and lower a cable attached thereto; and an actuator operably connected to the automated push-beam trolley.

9. The apparatus of claim 8, wherein the first L-shaped rail, the second L-shaped rail, the third L-shaped rail, and the fourth L-shaped rail each comprise:

an extension arm slidably disposed within a tube such that each L-shaped rail is extendable and collapsible by sliding the extension arm in or out of the tube, wherein the extension arm and the tube each have a bore extending transversely therethrough such that each L-shaped rail retains an extended configuration when the bore of the extension arm is aligned with the bore of the tube and a locking pin is inserted therethrough.

10. The apparatus of claim 8, further comprising a counterbalance removably secured to at least one of the first frame member and the second frame member opposite the end of the I-beam extending beyond the framed perimeter, wherein the counterbalance is configured to receive the first frame member, the second frame member, the I-beam, the push-beam trolley, and the actuator therein when the apparatus is unassembled.

* * * * *